US008328033B2

(12) United States Patent
Mast

(10) Patent No.: US 8,328,033 B2
(45) Date of Patent: Dec. 11, 2012

(54) HOT-FILL CONTAINER

(75) Inventor: Luke A. Mast, Brooklyn, MI (US)

(73) Assignee: Amcor Limited, Hawthorn (AU)

( * ) Notice: Subject to any disclaimer, the term of this patent is extended or adjusted under 35 U.S.C. 154(b) by 291 days.

(21) Appl. No.: 12/707,282

(22) Filed: Feb. 17, 2010

(65) Prior Publication Data

US 2010/0206892 A1 Aug. 19, 2010

Related U.S. Application Data

(60) Provisional application No. 61/153,460, filed on Feb. 18, 2009.

(51) Int. Cl.
*B65D 8/04* (2006.01)

(52) U.S. Cl. ..... 215/381; 215/382; 215/383; 215/384; 220/609; 220/666; 220/669; 220/672; 220/675

(58) Field of Classification Search ..... 215/381, 215/383, 384, 382; 220/609, 666, 669, 672, 220/675

See application file for complete search history.

(56) References Cited

U.S. PATENT DOCUMENTS

| | | | |
|---|---|---|---|
| 5,472,105 | A | 12/1995 | Krishnakumar et al. |
| 6,036,037 | A | 3/2000 | Scheffer et al. |
| 2002/0008077 | A1 | 1/2002 | Lane et al. |
| 2007/0075032 | A1 | 4/2007 | Kelley et al. |

*Primary Examiner* — Anthony Stashick
*Assistant Examiner* — Elizabeth Volz
(74) *Attorney, Agent, or Firm* — Harness, Dickey & Pierce, P.L.C.

(57) ABSTRACT

A one-piece plastic hot-fill container may employ a shoulder portion, a base portion and a sidewall portion, which may be integrally formed with and extend from the shoulder portion to the base portion. The container may further have a plurality of compression ribs molded into the sidewall portion in vertical and horizontal directions—at least the vertical compression ribs being operable to change from a first shape to a second shape in response to cooling of the liquid and further extending inwardly within the container.

13 Claims, 6 Drawing Sheets

HOT-FILL CONTAINER

CROSS-REFERENCE TO RELATED APPLICATIONS

This application claims the benefit of U.S. Provisional Application No. 61/153,460, filed on Feb. 18, 2009. The entire disclosure of the above application is incorporated herein by reference.

FIELD

The present disclosure relates to a hot-fill, heat-set container with vacuum absorbing ribs on a contoured body of the container.

BACKGROUND

This section provides background information related to the present disclosure which is not necessarily prior art.

Hot-fill plastic containers, such as those manufactured from polyethylene terephthalate ("PET"), have been commonplace for the packaging of liquid products, such as fruit juices and sports drinks, which must be filled into a container while the liquid is hot to provide for adequate and proper sterilization. Because these plastic containers are normally filled with a hot liquid, the product that occupies the container is commonly referred to as a "hot-fill product" or "hot-fill liquid" and the container is commonly referred to as a "hot-fill container."

During filling of the container, the product is typically dispensed into the container at a temperature of at least 180° F. Immediately after filling, the container is sealed or capped, such as with a threaded cap, and as the product cools to room temperature, such as 72° F., a negative internal pressure or vacuum builds within the sealed container. Although PET containers that are hot-filled have been in use for quite some time, such containers are not without their limitations.

One limitation of PET hot-fill containers is that because such containers receive a hot-filled product and are immediately capped, the container walls contract as vacuum forces increase during hot-fill product cooling. Because of this product contraction, hot-fill containers may be equipped with vertical columns and circumferential grooves. The vertical columns and circumferential grooves, which are normally parallel to the container's bottom resting surface, provide strength to the container to withstand container distortion and aid the container in maintaining much of its as-molded shape, despite the internal vacuum forces. Additionally, hot-fill containers may be equipped with vacuum panels to control the inward contraction of the container walls. The vacuum panels are typically located in specific wall areas immediately beside the vertical columns, and immediately beside and between the circumferential grooves so that the grooves and columns may provide support to the moving, collapsing vacuum panels yet maintain much of the overall shape of the container. Because of the necessity of the traditional vacuum panels in the container wall and support grooves above and below the vacuum panels to assist in maintaining the overall container shape, incorporating contour hand grips and other contours in the container wall, while preserving the ability of the container wall to absorb internal vacuum, is limited.

Therefore, there is a need in the relevant art to provide a hot-fill container with a wall that is capable of moving to absorb internal vacuum forces in response to cooling of an internal hot-fill liquid and capable of maintaining the overall shape of the container while providing a contoured hand grip area.

SUMMARY

This section provides a general summary of the disclosure, and is not a comprehensive disclosure of its full scope or all of its features.

According to the principles of the present teachings, a one-piece plastic hot-fill container is provided having a shoulder portion, a base portion and a sidewall portion, which may be integrally formed with and extend from the shoulder portion to the base portion. The container may further have a plurality of compression ribs molded into the sidewall portion in vertical and horizontal directions—at least the vertical compression ribs being operable to change from a first shape to a second shape in response to cooling of the liquid and further extending inwardly within the container.

Further areas of applicability will become apparent from the description provided herein. The description and specific examples in this summary are intended for purposes of illustration only and are not intended to limit the scope of the present disclosure.

DRAWINGS

The drawings described herein are not to scale and are for illustrative purposes only of selected embodiments and not all possible implementations, and are not intended to limit the scope of the present disclosure. Corresponding reference numerals indicate corresponding parts throughout the several views of the drawings.

DETAILED DESCRIPTION

Figure 1:
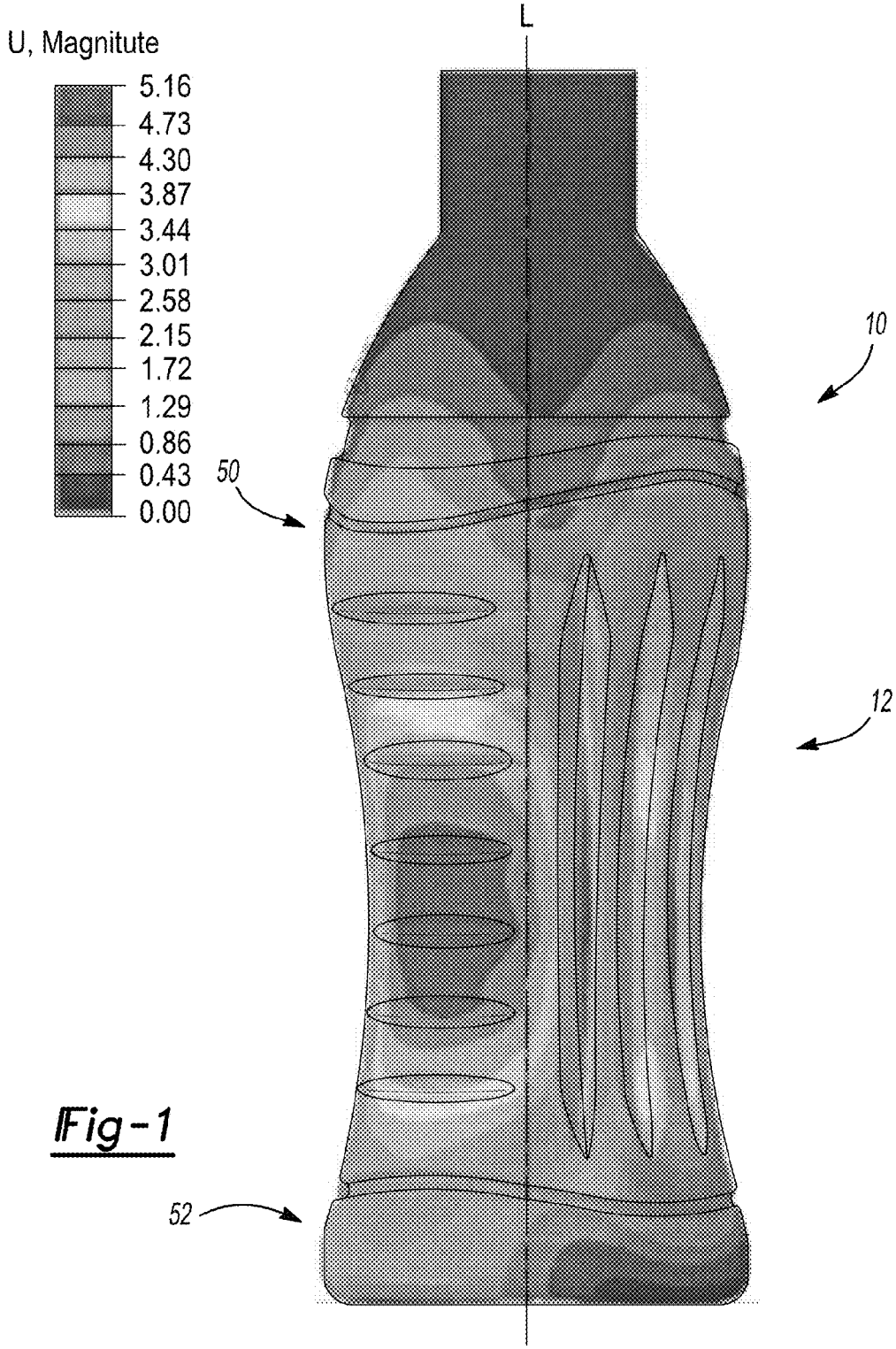
FIG. 1 is a quartering view of a container containing horizontally- and vertically-disposed vacuum absorbing ribs according to the teachings of the present disclosure showing a pressure gradient profile.

The following description is merely exemplary in nature and is not intended to limit the present disclosure, application, or uses. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Turning to FIGS. 1-3, details of a preferred embodiment of the present disclosure will be discussed. Turning first to FIG. 1, a one-piece plastic, e.g. polyethylene terephthalate (PET), container 10 is depicted with a longitudinal axis L and is substantially cylindrical. In this particular embodiment, the plastic container 10 has a volume capacity of about 12 fl. oz. (355 cc/mL).

As depicted in FIGS. 1, 2A-2C, and 4A-4B, the one-piece plastic container 10 defines a container body 12 and includes an upper portion 14 having a finish 16 and a neck 18. The finish 16 may have at least one thread 20 integrally formed thereon. A shoulder portion 22 extends downward from the finish 16. The shoulder portion 22 merges into and provides a transition between the finish 16 and a sidewall portion 24. The sidewall portion 24 extends downward from the shoulder portion 22 to a base portion 26 having a base 28, which may employ a contact ring.

The neck 18 may have an extremely short height—that is, becoming a short extension from the finish 16, or may have an elongated height, extending between the finish 16 and the shoulder portion 22. A circular support ring 34 may be defined around the neck 18. A threaded region 36 with its at least one thread 20 may be formed on an annular sidewall 38 above the support ring 34. The threaded region 36 provides a means for attachment of a similarly threaded closure or cap (not shown). The cap may define at least one thread formed around an inner diameter for cooperatively riding along the thread(s) 20 of the finish 16. Alternatives may include other suitable devices that engage the finish 16 of the plastic container 10. Accordingly, the closure or cap engages the finish 16 to preferably provide a hermetical seal of the plastic container 10. The closure or cap is preferably of a plastic or metal material conventional to the closure industry and suitable for subsequent thermal processing, including high temperature pasteurization and retort. The shoulder portion 22 may define a transition area from the neck 18 and upper portion 14 to a label panel area 40. The label panel area 40 therefore, may be defined between the shoulder portion 22 and the base portion 26, and located on the sidewall portion 24. It should be appreciated that other label panel areas, both in terms of size and shape, are anticipated.

Container 10 can further comprise various ribs disposed along shoulder portion 22, sidewall portion 24, and/or base portion 26. In some embodiments, sidewall portion 24 may include one or more generally-horizontal contour ribs 32 and one or more compression ribs 33. Generally-horizontal contour ribs 32 can be spaced apart from adjacent contour ribs 32 by contour lands 30. Similarly, as will be discussed herein, compression ribs 33 can be spaced apart from adjacent compression ribs 33 by compression lands 31.

Figures 2A, 2B, 2C:
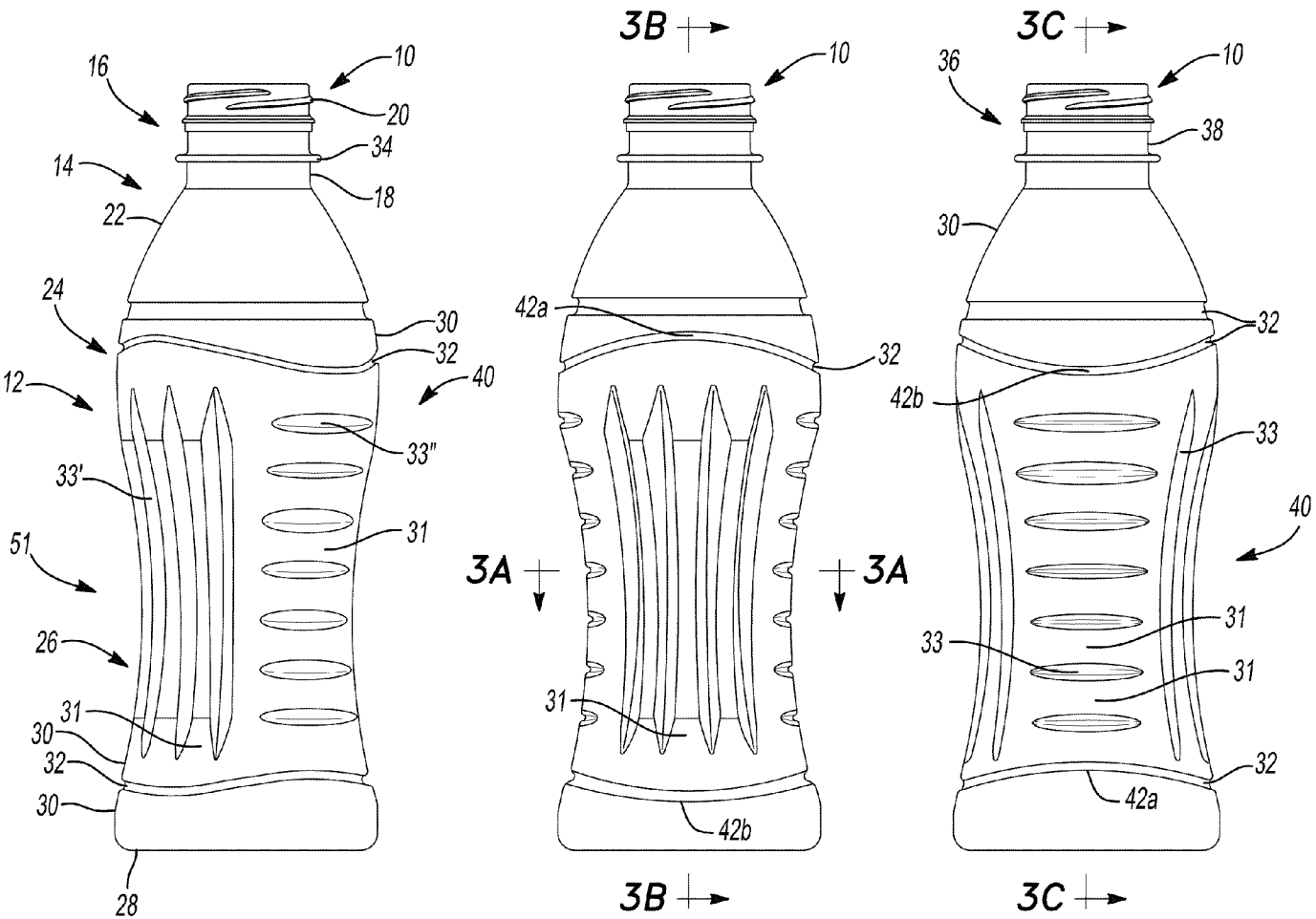
FIGS. 2A-2C are quartering, front, and side views of the container containing horizontally- and vertically-disposed vacuum absorbing ribs according to the teachings of the present disclosure.

With reference to FIGS. 1-2C, in some embodiments the contour ribs 32 may not be parallel to the support ring 34 or the base 28. Stated differently, the contour ribs 32 may be arcuate in one or more directions about the periphery of the body 12 and the sidewall portion 24 of the container 10. More specifically, in side views as depicted in FIGS. 2A-2C, the contour ribs 32 may be arced such that a center of the contour ribs 32 is arced upward toward the neck 18, as in 42*a*, or arced downward toward the base 28, as in 42*b*. Such may be the case for all of the contour ribs 32 in the container 10 when viewed from the same side of the container 10. In rotating the container 10 and following the contour ribs 32 for 360 degrees around the container 10, the contour ribs 32 may have two (2) equally high, highest points, and two (2) equally low, lowest points. It should also be noted that the width of contour ribs 32 can vary, as depicted in FIGS. 1 and 2A-2C.

With continued reference to FIGS. 1, 2A-2C, and 4A-4B, it can be seen that the compression ribs 33 may oriented in any direction—such as orthogonal to the base 28 (generally indicated at 33' in FIG. 2A) and parallel to the base 28 (generally indicated at 33" in FIG. 2A). Stated differently, the compression ribs 33 may extend both vertically and horizontally, and, in some embodiments such as those illustrated, can be used simultaneously. In some embodiments, compression ribs 33' (vertical) can be placed along only a portion of the container periphery. Moreover, those portions where compression ribs 33' are placed can be mirrored 180 degrees across from each other. This allows compression ribs 33' to induce an accordion-like action on the cross section of the container under the forces of vacuum. The sides directly adjacent to the vertical compression ribs 33' are strengthened with horizontal compression ribs 33" that act, in part, as stiffening ribs to be rigid enough to resist substantially all deformation under vacuum so that substantially all of the movement occurs within the vertical compression ribs 33'. The main body of the container as described above with vertical collapsing ribs 33' and horizontal stiffening ribs 33" is framed above and below with continuous horizontal contour ribs 32 to isolate the active geometry and prevent container ovalization. This force response can be seen in FIG. 1.

Figure 3A:
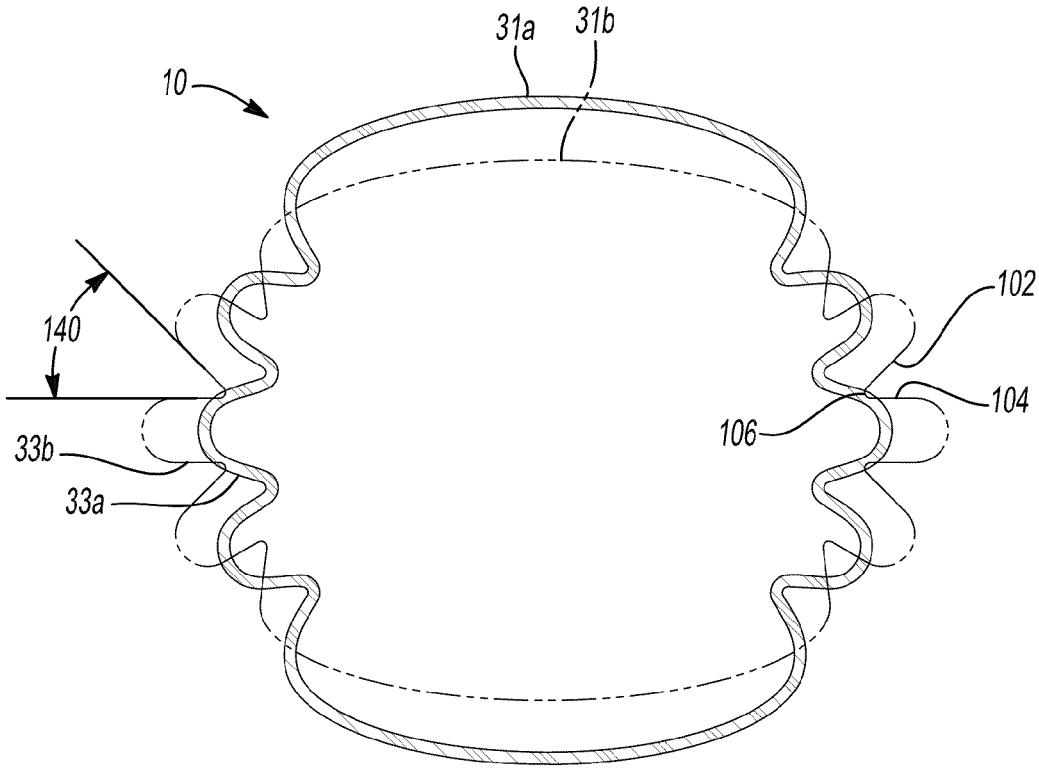
FIG. 3A is a horizontal schematic cross-sectional view of the container depicting the ribs and the container wall taken through Line 3A-3A of FIG. 2B.
Figure 3B:
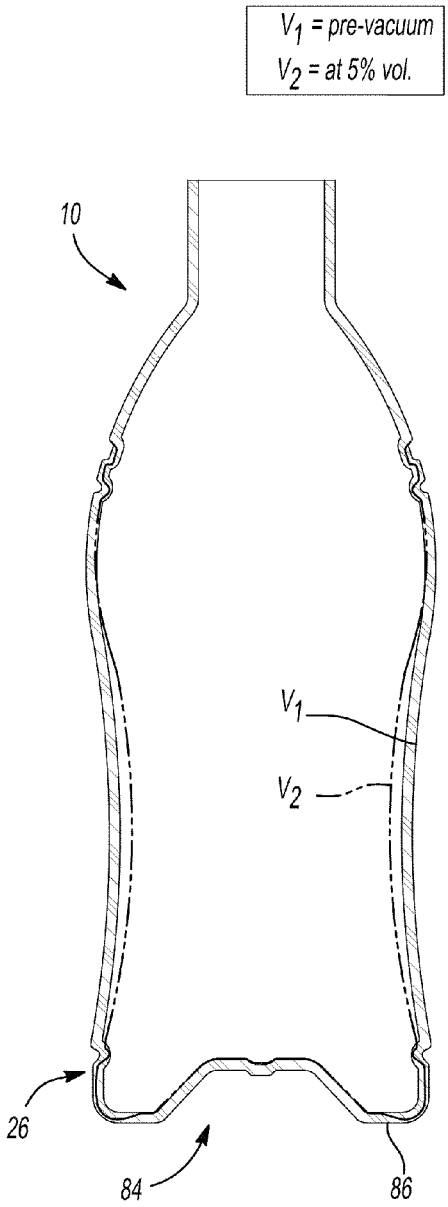
FIG. 3B is a vertical schematic cross-sectional view of the container depicting the ribs and the container wall taken through Line 3B-3B of FIG. 2B.
Figure 3C:
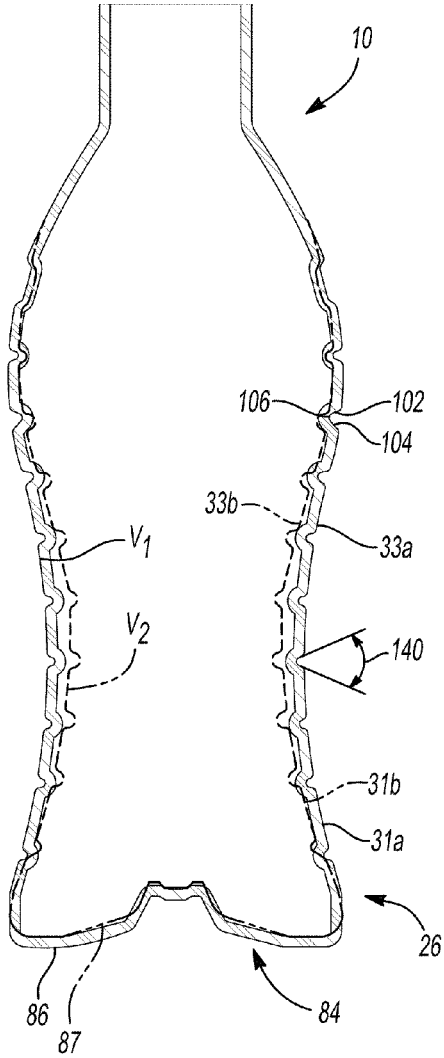
FIG. 3C is a vertical schematic cross-sectional view of the container depicting the ribs and the container wall taken through Line 3C-3C of FIG. 2C.
Figure 4A:
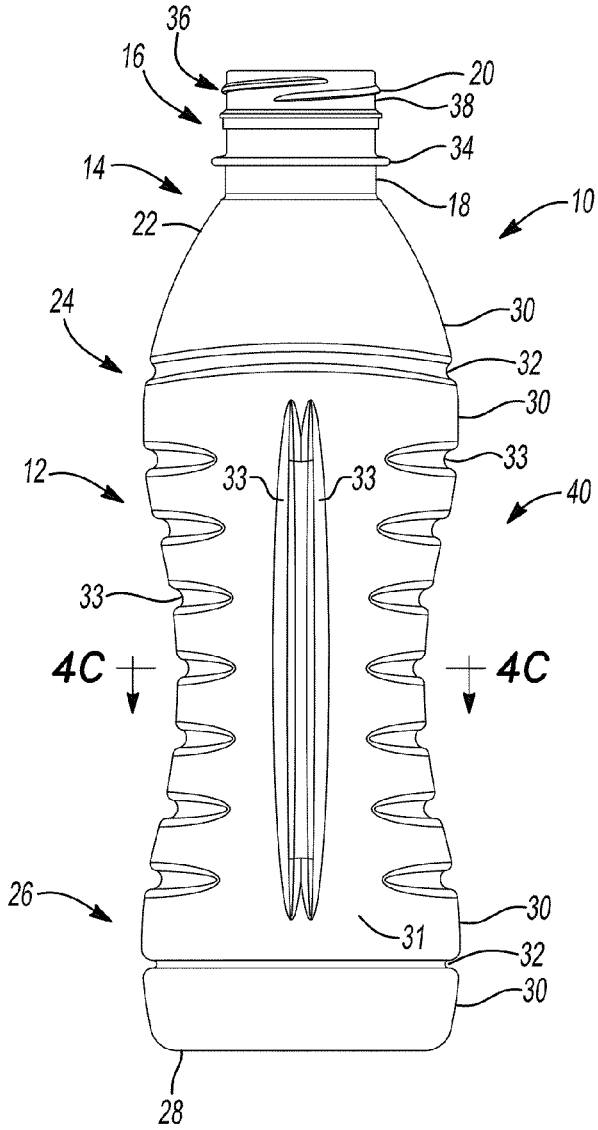
FIGS. 4A-4B are front and side views of the container containing horizontally- and vertically-disposed vacuum absorbing ribs according to some embodiments of the present disclosure.
Figure 4B:
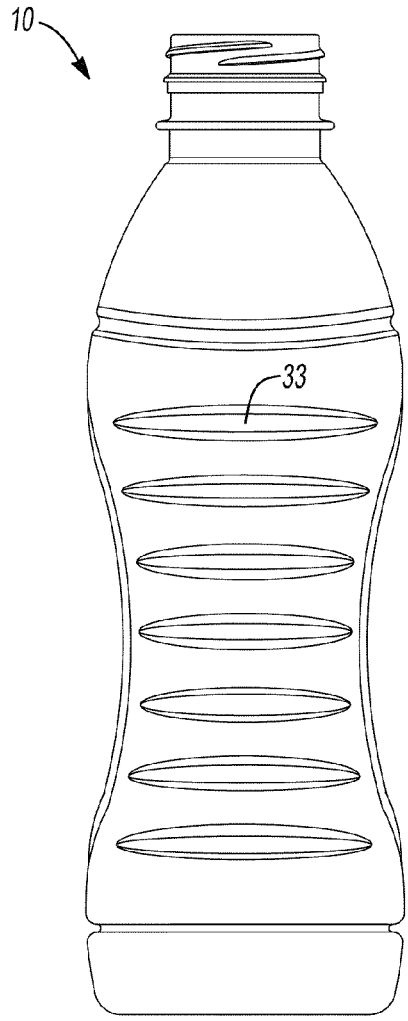
Figure 4C:
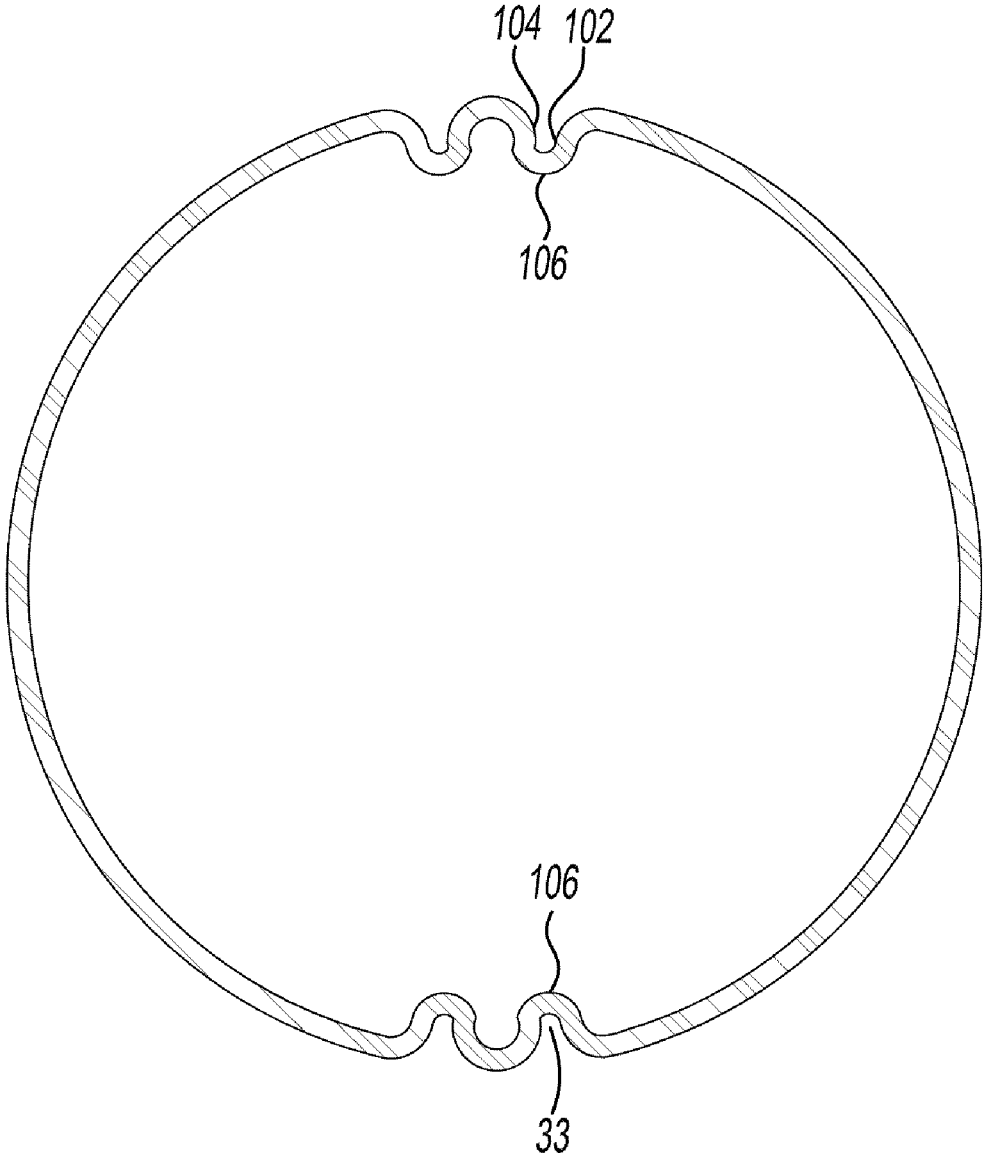
FIG. 4C is a horizontal schematic cross-sectional view of the container depicting the ribs and the container wall taken through Line 4C-4C of FIG. 4A.

FIGS. 3A-3C depict a horizontal, schematic cross-section of the container 10 at line 3A-3A of FIG. 2B, a vertical, schematic cross-section of the container 10 at line 3B-3B of FIG. 2B, and a vertical, schematic cross-section of the container 10 at line 3C-3C of FIG. 2C, respectively. The cross-sectional views of FIGS. 3A-3C also more clearly depict the arrangement and protrusion of the compression ribs 33 and the compression land 31 extending therebetween. The compression ribs 33, because of their protrusion inwardly toward the interior of the container 10, are able to collapse upon themselves to a certain degree when the vacuum within the container 10 reaches a predetermined or prescribed pressure. The pressure at which the compression ribs 33 will collapse upon themselves is dependent not only upon the vacuum forces within the container 10, but also upon the distance or degree that a specific rib of the container 10 protrudes internally into the container 10, away from the sidewall portion 24, the wall thickness, and the stiffness thereof. Generally, the larger the compression rib 33, the greater the ability of the respective rib to absorb vacuum forces. In some embodiments, compression ribs 33 are positioned equidistant about a portion of container 10 when viewed from the side and/or above.

In some embodiments, as seen in FIG. 1, the size of a single compression rib 33 may vary along its length to achieve a tailored deformation response when exposed to internal vacuum forces (or the relief thereof). For instance, the cross-section dimensional size of compression rib 33 may be larger along one section and smaller along another section such that when gripped by a user, the area under the user's hand does not vary substantially in size when the cap is removed from the container thereby allowing air to rush into the container 10 causing the compression ribs 33 to expand or de-contract. Because the size and/or shape of the compression ribs 33 are tailor for a gripping area and a non-gripping area, the non-gripping area(s) can be designed to contract and de-contract more than the compression ribs 33 in the gripping area, thereby preventing the user for losing their grip on the container. Similarly, the same principles can be used for accommodating container labels and the like. The compression ribs 33 are designed in order to maximize compressive movement of the sidewall using the compression ribs 33. Another factor that will affect the collapsibility of the opposing walls of the compression ribs 33 is the wall thickness of the container 10, which may vary by location within the container 10, and the actual material of the container 10.

With reference to the figures, details of the compression ribs 33 will be discussed. As depicted in FIGS. 2A-2C and 4A-4B, to achieve the desired overall contour of the container 10, the upper body portion 50 may be of the same diameter as the lower body portion 52, but include an intermediate body portion 51 of reduced diameter defining a relatively-enlarged upper body portion 50. The increase in diameter between intermediate body portion 51 and upper body portion 50 can serve as a convenient gripping area. By designing the container 10 in such a manner, and by incorporating compression ribs 33 as a vacuum absorbing sidewall, the container possesses the advantage of being easier for a human hand to grip when compared to a non-contoured container, and less likely to fall from a hand that is holding the container 10 because the upper body portion 50 is larger than the intermediate body portion 51.

Additionally, the compression ribs 33 may have different dimensions along their length to further enhance a human hand grip and orientation. Moreover, another advantage of using different compression rib dimensions and orientations is that an aesthetically pleasing container 10 may also be achieved. Yet another advantage of using different contour rib dimensions is structural support. At the larger diameter areas of the container 10, more structural support is required because the wall thickness in these areas generally tend to be thinner. As such, larger, wider compression ribs 33 are provided in these areas to add more structural support in these areas, thereby increasing the dent resistance and hoop strength in these areas.

Continuing with FIGS. 3B and 3C, the base portion 26 will be further discussed. More specifically, the base portion 26 may have a recessed portion known as a push-up 84 that lies within a contact ring 86. The push-up 84 may be molded to contain its own strengthening ribs 87 and several pieces of identifying information (not depicted), such as a product ID, recycling logo, corporate loge, etc. The contact ring 86 may be the flat area of the container 10 that contacts a support surface when the container 10 is in its upright position. More specifically, the contact ring 86 lies outside of the area of the push-up 84 and within an overall outside diameter of the base portion 26.

Turning now to FIGS. 2A-2C and 3A-3C, details of the compression ribs 33 will be discussed. More specifically, the compression ribs 33 may each have a first wall 102 and a second wall 104 separated by an inner curved wall 106, which is in part defined by a relatively sharp or small innermost radius. The relatively sharp innermost radius of inner curved wall 106 facilitates improved material flow during blow molding of the plastic container 10 thus enabling the formation of relatively large contour ribs. The relatively large portion of compression ribs 33 are generally better able to absorb internal vacuum forces and forces due to top loading than more shallow ribs, because a longer first wall 102 and a longer second wall 104 provide more of a cantilever to pivot at the inner curved wall 106.

Continuing with FIG. 3A, the container 10 may utilize a compression rib 33 employing the first wall 102 with a first length and the second wall 104 with a second length. In some embodiments, the first length and the second length are identical. In some embodiments, the first length and the second length are identical to each other at a given position, but each varies along the length of a single compression rib 33. In some embodiments, the first length and the second length are different for a given position.

As depicted in FIGS. 3A-3C, the above-described compression rib 33 has a radii, walls, depth and width, which in combination form a rib angle or shape 140 that may, in an unfilled plastic container 10, define an initial angle or shape. After hot-filling, capping and cooling of the container contents, the resultant vacuum forces may cause the rib angle or shape 140 to reduce to a capped angle or shape that is less than the initial angle or shape as a result of vacuum forces present within the plastic container 10. However, in some embodiments, compression ribs 33 are designed so that although the rib angle or shape 140 may be further reduced to absorb vacuum forces, the first wall 102 and second wall 104 never come into contact with each other as a result of vacuum forces. It should be recognized that first wall 102 and second wall 104 can be, in some embodiments, a curved surface defining an arc. That is, rather than first wall 102 and second wall 104 being triangularly-shaped, in some embodiments, first wall 102 and second wall 104 can define a convex shaped curved surface that is at least partially collapsible in response to vacuum forces.

Compression ribs 33 are designed to achieve optimal performance with regard to vacuum absorption, top load strength and dent resistance by compressing slightly in a cross-sectional plane of the rib to accommodate for and absorb vacuum forces resulting from hot-filling, capping and cooling of the container contents. Compression ribs 33 are designed to withstand and provide structural reinforcement when the filled container is exposed to top load forces, such as during container stacking. After filling, the plastic container 10 may be bulk packed on pallets and then stacked one on top of another resulting in top load forces being applied to the container 10 parallel to the central vertical axis L during storage and distribution.

As depicted in FIGS. 2A-2C and 3A-3C, compression lands 31 are generally convex as molded. However, the degree to which they are convex will change depending on the severity of constriction of compression ribs 33. As seen in FIGS. 3A-3C, compression lands 31, when initially molded, extend outwardly from compression ribs 33. In other words, compression lands 31 define a generally arcuate shape 31*a* initially that will lessen upon cooling of the hot fill liquid and the constriction of compression ribs 33 to a final shape 31*b*. Similarly, compression ribs 33, when initially molded (see reference numeral 33*a*), define a greater angle 140 that will lessen upon cooling of the hot fill liquid and the associated constriction of compression ribs 33 to a final shape 33*b*. The inward movements of compression lands 31 cause the radii of the compression ribs 33 to tighten and become smaller; which increases structural hoop strength and provides vertical support, thereby increasing top-load strength.

The container 10 has been designed to retain a commodity, which may be in any form, such as a solid or liquid product. In one example, a liquid commodity may be introduced into the container 10 during a thermal process, typically a hot-fill process. For hot-fill bottling applications, bottlers generally fill the container 10 with a liquid or product at an elevated temperature between approximately 155° F. to 205° F. (approximately 68° C. to 96° C.) and seal the container 10 with a cap or closure before cooling. In addition, the container 10 may be suitable for other high-temperature pasteurization or retort filling processes or other thermal processes as well. In another example, the commodity may be introduced into the container 10 under ambient temperatures.

According to the principles of the present teachings, the container disclosed here provides a number of advantages over prior art designs, including focusing internal vacuum forces uniformly to the rigid and opposing sides of the container walls, causing the flexible compression ribs on the adjacent side walls to collapse inward to a lesser angle. This results in low residual vacuum inside the container after cooling, which decreases the risk of deformation, ovalization (unless desired), denting, and other defects associated with the internal vacuum forces generated by hot-filled beverages. Moreover, as the container side panels move inward due to the internal vacuum forces causing the vertical ribs to contract into a smaller diameter, the hoop strength and vertical stiffness of the container is increased. The result is an increase in top load strength that is a benefit for secondary packaging and palletizing. Still further, the decrease in residual vacuum combined with an increase in top-load strength may lead to a reduction in thermoplastic material thickness and weight, providing a lower cost container without sacrificing container performance. Using a combination of vertical and horizontal rib features can provide multiple ways to grip the container, making it more ergonomic for the consumer.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A one-piece plastic container for containing a liquid, said container comprising:

an upper portion;

a base portion closing off an end of the container;

a sidewall portion integrally formed with and extending from the upper portion to the base portion; and a plurality of compression ribs molded into said sidewall portion and extending inwardly therefrom, a first portion of said plurality of compression ribs being disposed in a vertical direction and a second portion of said plurality of compression ribs being disposed in a horizontal direction, each of said plurality of compression ribs in said first portion having a respective cross section taken in the horizontal direction, each of said plurality of compression ribs in said first portion having a width in the respective cross section, said width changing from a first width to a second width in response to cooling of the liquid.

2. The one-piece plastic container according to claim 1 wherein at least one of said compression ribs in said first portion is positioned between opposing groups of said compression ribs in said second portion.

3. The one-piece plastic container according to claim 1 wherein said first portion of said compression ribs is arranged in mirror symmetry about said sidewall portion.

4. The one-piece plastic container according to claim 1 wherein each of said plurality of compression ribs in said first portion defines an angle, and wherein said angle changes from a first angle to a second angle in response to cooling of the liquid, said second angle being less than said first angle.

5. The one-piece plastic container according to claim 1 wherein each of said plurality of compression ribs in said first portion defines an arc, and wherein said arc changes from a first arc to a second arc in response to cooling of the liquid, said second arc being less than said first arc.

6. The one-piece plastic container according to claim 1 wherein said first portion of said plurality of compression ribs generally absorb a substantial portion of internal vacuum forces and said second portion of said plurality of compression ribs generally resist a substantial portion of the internal vacuum forces.

7. The one-piece plastic container according to claim 1 wherein each of said plurality of compression ribs in said first portion comprises a first wall and a second wall joined along an inner wall, said first wall and said second wall pivoting relative to each other about said inner wall in response to said cooling of the liquid.

8. The one-piece plastic container according to claim 7, further comprising:

lands formed in said sidewall portion and positioned between each of said plurality of compression ribs, said first, second, and inner walls extending inwardly from said lands.

9. The one-piece plastic container according to claim 7 wherein said first wall is larger than said second wall in the respective cross section at a given container elevation.

10. The one-piece plastic container according to claim 7 wherein said first wall is disposed at an angle relative to said second wall, wherein said angle changes from a first angle to a second angle in response to cooling of the liquid, said second angle being less than said first angle.

11. The one-piece plastic container according to claim 1 wherein dimensions of at least one of said plurality of compression ribs vary along a length thereof.

12. The one-piece plastic container according to claim 11, wherein said width of at least one of the plurality of compression ribs in said first portion varies along a longitudinal length thereof.

13. The one-piece plastic container according to claim 12, wherein said sidewall portion defines a first sidewall width and said at least one of the plurality of compression ribs has a first rib width at a first container elevation, wherein said sidewall portion defines a second sidewall width and said at least one of the plurality of compression ribs has a second rib width at a second container elevation, wherein said first sidewall width is greater than said second sidewall width, and wherein said first rib width is greater than said second rib width.

* * * * *